US008533978B2

(12) United States Patent
Volin

(10) Patent No.: US 8,533,978 B2
(45) Date of Patent: Sep. 17, 2013

(54) METHOD AND SYSTEM FOR FASTENING FOOTWEAR HAVING RELEASABLY LOCKING DEVICE(S)

(76) Inventor: Dee Volin, Fairview, OR (US)

( * ) Notice: Subject to any disclaimer, the term of this patent is extended or adjusted under 35 U.S.C. 154(b) by 526 days.

(21) Appl. No.: 12/804,998

(22) Filed: Aug. 2, 2010

(65) Prior Publication Data

US 2011/0035961 A1 Feb. 17, 2011

Related U.S. Application Data

(60) Provisional application No. 61/274,163, filed on Aug. 12, 2009.

(51) Int. Cl.
*A43C 11/00* (2006.01)

(52) U.S. Cl.
USPC ..... 36/50.1; 24/712.2; 24/712.3

(58) Field of Classification Search
USPC ..... 36/50.1, 54; 24/712.2, 712.3
See application file for complete search history.

(56) References Cited

U.S. PATENT DOCUMENTS

| | | | | |
|---|---|---|---|---|
| 502,256 | A | 7/1893 | Matchett | |
| 879,272 | A | 2/1908 | Key | |
| 2,088,851 | A | 8/1937 | Gantenbein | |
| 2,109,751 | A | 3/1938 | Matthias et al. | |
| 2,871,537 | A | 2/1959 | Hickerson | |
| 3,193,950 | A * | 7/1965 | Liou | 36/50.1 |
| 3,279,015 | A | 10/1966 | Henning | |
| 3,299,543 | A * | 1/1967 | Merritt | 36/54 |
| 4,053,995 | A | 10/1977 | Shein | |
| 4,071,964 | A * | 2/1978 | Vogiatzis | 36/50.1 |
| 4,081,916 | A * | 4/1978 | Salisbury | 36/50.1 |
| 4,114,297 | A | 9/1978 | Famolare, Jr. | |
| 4,571,854 | A | 2/1986 | Edens | |
| 4,878,269 | A | 11/1989 | Anscher | |
| 4,879,787 | A | 11/1989 | Walls | |
| 5,129,130 | A | 7/1992 | Lecouturier | |
| 5,333,398 | A | 8/1994 | Seo | |
| 5,353,483 | A * | 10/1994 | Louviere | 24/712.1 |
| 5,388,315 | A * | 2/1995 | Jones | 24/712.1 |
| 5,467,511 | A | 11/1995 | Kubo | |
| 5,469,640 | A * | 11/1995 | Nichols | 36/50.1 |
| 5,564,203 | A * | 10/1996 | Morris | 36/50.1 |
| 5,640,785 | A | 6/1997 | Egelja | |
| 6,029,323 | A | 2/2000 | Dickie | |
| 6,212,797 | B1 | 4/2001 | Merry | |
| 6,282,817 | B1 * | 9/2001 | Curet | 36/50.1 |
| 6,339,867 | B1 | 1/2002 | Azam | |
| 6,532,688 | B2 | 3/2003 | Bouvier | |
| 6,568,104 | B2 | 5/2003 | Liu | |
| 6,701,590 | B2 | 3/2004 | Voughlohn | |
| 6,718,602 | B1 | 4/2004 | Chang | |
| 6,779,281 | B1 | 8/2004 | Liu | |
| 6,823,610 | B1 | 11/2004 | Ashley | |
| 6,895,696 | B1 | 5/2005 | Sanders | |
| 7,036,193 | B1 | 5/2006 | Liu | |
| 7,120,375 | B2 | 10/2006 | Ransom | |
| 7,293,373 | B2 * | 11/2007 | Reagan et al. | 36/50.1 |
| 7,313,849 | B2 | 1/2008 | Liu | |
| 7,343,652 | B1 | 3/2008 | Liu | |
| 7,596,838 | B1 | 10/2009 | Bulmer | |
| 7,657,980 | B2 | 2/2010 | Liu | |

(Continued)

*Primary Examiner* — Marie Patterson

(57) ABSTRACT

A unique system has a releasably locking device for quickly and easily locking and releasing a loop-section fastener on and from a loop without the needs for taking the loop apart respectively.

19 Claims, 9 Drawing Sheets

(56) References Cited

U.S. PATENT DOCUMENTS

| | | | | |
|---|---|---|---|---|
| 7,735,242 | B2 | 6/2010 | Seliger | |
| 2003/0204969 | A1* | 11/2003 | Liu | 36/50.1 |
| 2004/0172851 | A1* | 9/2004 | Curet | 36/50.1 |
| 2006/0053658 | A1* | 3/2006 | Voughlohn | 36/50.1 |
| 2008/0235995 | A1* | 10/2008 | Reagan et al. | 36/117.1 |
| 2009/0100707 | A1* | 4/2009 | Bar et al. | 36/50.1 |
| 2010/0192411 | A1* | 8/2010 | Leick | 36/50.1 |

* cited by examiner

METHOD AND SYSTEM FOR FASTENING FOOTWEAR HAVING RELEASABLY LOCKING DEVICE(S)

REFERENCE TO PREVIOUSLY FILED PROVISIONAL PATENT APPLICATION

Provisional Patent Application No. 61/274,163 was filed on Aug. 12, 2009.

TECHNICAL FIELD OF THE INVENTION

The application applies for unique system and method for fastening lacing-type footwear.

BACKGROUND OF THE INVENTION

Lacing-type footwear is an important part of our life, but adjusting, tying, and untying laces are time-consuming and frustrating. Plus, bow knots and lace ends are cumbersome, snagging, and hazardous. Accordingly, there are ever-increasing demands for a convenient, safe, and aesthetic system, which could fasten a footwear quickly and easily, could be locked on and released from a footwear quickly and easily, and is affordable, compact, and simple without any cumbersome, hazardous bow knots, lace ends, and components.

PRIOR ART

Prior arts heretofore have dragging, tripping, snagging, poking, and abrading problems of either messy hazardous bow knots and lace ends, or cumbersome hazardous devices, or both. A number of cumbersome, hazardous devices have been introduced in: U.S. Pat. No. 502,694, filed Aug. 8, 1893, to Frederick H. Smith; U.S. Pat. No. 879,272, filed Jul. 26, 1907, to Calvin Jones Key; U.S. Pat. No. 2,088,851, filed Sep. 16, 1936, to J. E. Gantenbein; U.S. Pat. No. 2,109,751, filed Apr. 3, 1936, to E. Matthias Et Al; U.S. Pat. No. 2,871,537, filed Jan. 9, 1957, to Frederick R. Hickerson; U.S. Pat. No. 3,279,015, filed Aug. 24, 1964, to Lawrence M. Henning; U.S. Pat. No. 4,053,995, filed Jul. 23, 1976, to Melvin Shein; U.S. Pat. No. 4,114,297, filed Apr. 27, 1977, to Joseph P. Famolare, Jr.; U.S. Pat. No. 4,571,854, filed Apr. 22, 1983, to Robert B. Edens; U.S. Pat. No. 4,878,269, filed Jul. 1, 1988, to Joseph A. Anscher; U.S. Pat. No. 4,879,787, filed Oct. 3, 1988, to Thomas J. Walls; U.S. Pat. No. 5,129,130, filed May 20, 1991, to Jacques Lecouturier; U.S. Pat. No. 5,333,398, filed Nov. 6, 1992, to Young S. Seo; U.S. Pat. No. 5,467,511, filed Apr. 19, 1994, to Yoshihiro Kubo; U.S. Pat. No. 5,640,785, filed Dec. 1, 1994, to Sinisa Egelja; U.S. Pat. No. 6,029,323, filed Jun. 15, 1998, to Robert G. Dickie; U.S. Pat. No. 6,212,797, filed Jun. 15, 1999, to David Merry; U.S. Pat. No. 6,339,867, filed Aug. 29, 2000, to Guy Azam; U.S. Pat. No. 6,532,688, filed Jun. 26, 2001, to Jean-Michel Bouvier; U.S. Pat. No. 6,568,104, filed Aug. 28, 2001, to Kun-Chung Liu; U.S. Pat. No. 6,701,590, filed Aug. 10, 2001, to Dee Voughlohn; U.S. Pat. No. 6,718,602, filed Aug. 20, 2002, to Chang Chao-Nan; U.S. Pat. No. 6,779,281, filed Feb. 12, 2003, to Kun-Chung Liu; U.S. Pat. No. 6,823,610, filed Dec. 6, 2002, to John P. Ashley; U.S. Pat. No. 6,895,696, filed Jun. 31, 2003, to Aric Sanders; U.S. Pat. No. 7,036,193, filed. Mar. 14, 2005, to Kun-Chung Liu; U.S. Pat. No. 7,313,849, filed Aug. 24, 2005, to Kun-Chung Liu; U.S. Pat. No. 7,343,652, filed Sep. 18, 2006, to Kun-Chung Liu; U.S. Pat. No. 7,596,838, filed Dec. 21, 2007, to Donald L. Bulmer; U.S. Pat. No. 7,657,980, filed Jan. 31, 2007, to Kun-Chung Liu; U.S. Pat. No. 7,735,242, filed Nov. 21, 2006, to Sven Seliger. These aforementioned prior-art patents teach that to fasten a footwear on a foot, a user ties lace ends of a lace together into lengthy, hazardous bows and lace ends, fastens them to a cumbersome, hazardous, expensive device, and exposes them, causing dragging, tripping, snagging, poking, and abrading problems and, thus, inevitable personal injury. They also teach that to release a device from a lace, the lace needs to be untied and/or taken apart. They do not describe nor show a unique system for fastening a footwear on a foot at at least one predetermined tension of a loop. They do not describe nor show a releasably locking device for quickly and easily locking and releasing a loop-section fastener on and from a loop without the needs for taking the loop apart. Therefore, all prior arts heretofore teach away from the present invention.

OBJECTS AND ADVANTAGES OF THE INVENTION

The present invention substantially departs from the conventional concepts and designs of the prior arts. In doing so, the invention provides a unique system having many unique and significant advantages, as follows:

1) An object of the invention is that the loop-section fastener of the unique system can be locked, quickly and easily, on a loop without the need for taking the loop apart;
2) Another object of the invention is that the loop-section fastener of the unique system can be released, quickly and easily, from a loop without the need for taking the loop apart;
3) A further object of the invention is that the loop-section fastener of the unique system can be replaced, quickly and easily, on a loop without the need for taking the loop apart;
4) Another object of the invention is that the loop-section fastener of the unique system can be interchanged, quickly and easily, on a loop without the need for taking the loop apart;
5) Still another object of the invention is that the loop-section fastener of the unique system can have slip-preventing device(s) integrated into its surface (for example, to create wavy, hilly, or grainy surface) to prevent it from being slippery such that the loop-section fastener can be held and operated securely;
6) Another object of the invention is that the tension of the loop of the unique system can be adjustable;
7) A further object of the invention is that the unique system automatically fastens a footwear on a foot at at least one predetermined tension of the loop of the unique system, every time the footwear is fastened on a foot;
8) Another object of the invention is that the unique system automatically lifts the tongue of a footwear between the two opposite sides of the footwear at the level of the two top opposite loop-receivers of the footwear, every time the footwear is fastened on a foot;
9) Still another object of the invention is that the unique system automatically centers the tongue of a footwear between the two opposite sides of the footwear at the level of the two top opposite loop-receivers of the footwear, every time the footwear is fastened on a foot;
10) Another object of the invention is that the unique system automatically locks the tongue of a footwear between the two opposite sides of the footwear at the level of the two top opposite loop-receivers of the footwear, every time the footwear is fastened on a foot;
11) A further object of the invention is that the unique system automatically interlocks the tongue and the two opposite sides of a footwear at the level of the two top opposite loop-receivers of the footwear, every time the footwear is fastened on a foot;

12) Another object of the invention is that the unique system automatically interlocks the tongue of a footwear and the loop sections of the loop of the unique system at the level of the two top opposite loop-receivers of the footwear, every time the footwear is fastened on a foot;

13) Still another object of the invention is that the unique system can hide a loop section, lace ends, and/or lace-end fastener inside the tongue of a footwear and prevent them from moving;

14) Another object of the invention is that the unique system only needs to be assembled once to set at least one predetermined loop tension or lace tension, which can be reset any time;

15) A further object of the invention is that the unique system eliminates the needs for adjusting and/or tying a lace every time a footwear is fastened on a foot;

16) Another object of the invention is that the unique system eliminates the needs for adjusting and/or untying a lace every time a footwear is unfastened from a foot;

17) Still another object of the invention is that the unique system is inexpensive, compact, safe, and simple. Thus, it can be used by people of almost any age;

18) Another object of the invention is that the unique system applies an interlocking method. Thus, the harder it is pulled, the more securely it fastens a footwear on a foot;

19) A further object of the invention is that the unique system only needs one finger to be operated;

20) Another object of the invention is that the unique system creates a smooth and sophisticated profile for a footwear;

21) Still another object of the invention is that the unique system can also serve as a decoration for a footwear, for example, when partially or entirely powder-coated with attractive color; and 22) Another object of the invention is that the unique system can also serve as a safety system, for example, when partially or entirely made of light-reflecting material.

Other objects and advantages of the invention will become apparent from the ensuing specification and its accompanying drawings.

SUMMARY OF THE INVENTION

A unique system has a releasably locking device for quickly and easily locking and releasing a loop-section fastener on and from a loop without the needs for taking the loop apart, respectively. The unique system comprises a plurality of opposite loop receivers of a footwear, a tongue of the footwear, a loop, a loop-section fastener, and a releasably locking device. The footwear has two opposite sides, on which the opposite loop receivers are disposed, respectively. The tongue has at least one opening and outer and inner surfaces. Each of the at least one openings extends from the outer surface to the inner surface. The loop has a plurality of loop sections. The footwear is laced with the loop, such that each of the loop sections extends between two of the loop-receivers on the same side, and such that the loop is threaded through the at least one opening of the tongue. The loop-section fastener is for at least one of the loop sections to be fastened thereon and for at least one of the loop sections to be unfastened therefrom to fasten the footwear on and to unfasten the footwear from a foot, respectively. The releasably locking device is integrated into the loop-section fastener for quickly and easily locking the loop-section fastener on the loop and for quickly and easily releasing the loop-section fastener from the loop. The unique system can also fasten the footwear on a foot at at least one predetermined tension of the loop; the system can also interlock the tongue with the two opposite sides of the footwear; and the system can also lift, center, and lock the tongue between the two top opposite ones of the opposite loop receivers of the footwear.

LOOP-SECTION FASTENER WITH RELEASABLY LOCKING DEVICE

Structure

Figure 1:
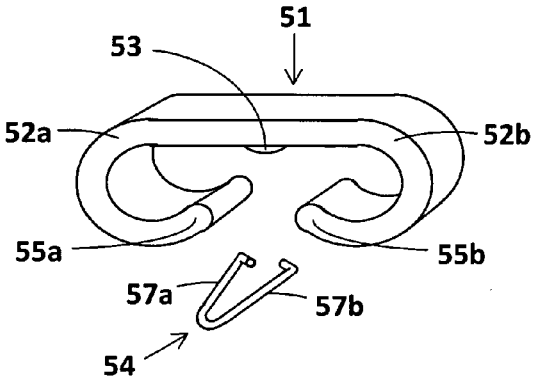
FIGS. 1, 2, 3, and 4 illustrate a loop-section fastener having a releasably locking device.
Figure 2:
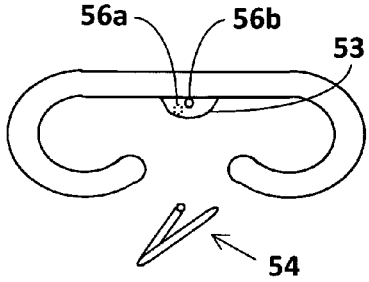

FIGS. 1 and 2 illustrate the perspective and side views of a loop-section fastener 51. Loop-section fastener 51 comprises two opposite hooks 52*a* and 52*b*, a base 53, and a releasably locking device 54. Two opposite hooks 52*a* and 52*b* are integrated into each other, and have two opposite hook tips 55*a* and 55*b*, respectively. Base 53 is half-pie-shaped, and is integrated into the under-sides of two opposite hooks 52*a* and 52*b*. Base 53 has two opposite sides and upper and lower recesses 56*a* and 56*b* disposed at predetermined locations thereon, respectively. Releasably locking device 54 comprises a predetermined C-shaped or V-shaped spring, which has two spring ends bent inwards. The C-shaped or V-shaped spring comprises two uneven spring halves 57*a* and 57*b*, which are on two intersecting planes, respectively.

Figure 3:
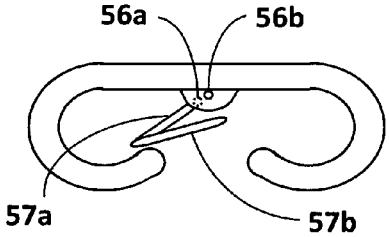
Figure 4:
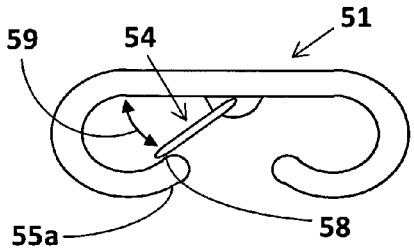

FIGS. 3 and 4 illustrate the assemblage of loop-section fastener 51. The spring ends of spring halves 57*a* and 57*b* are inserted into recesses 56*a* and 56*b*, respectively, to pivotably integrate spring halves 57*a* and 57*b* into base 53 and to make spring halves 57*a* and 57*b* generally parallel with each other to create a springing force. The springing force pushes releasably locking device 54 back to its original form and, therefore, pushes releasably locking device 54 against hook tip 55*a* at a contacting area 58, to close the mouth of hook 52*a*. Releasably locking device 54 can pivot in either one of the opposite directions of an arrow 59 to open or close the mouth of hook 52*a*.

Function

Hook tip 55*a* is predeterminedly bent inward to narrow the mouth of hook 52*a*, such that hook tip 55*a* is capable of preventing hook 52*a* from snagging, poking, etc., and such that hook 52*a* is capable of securely fastening a loop section thereon when the loop section is hooked thereon, regardless of the tension of the loop section (for example, the loop section can be on a worn or unworn footwear, and the tension of the loop section can be loose or tight or anywhere in between).

Hook tip 55*b* is predeterminedly bent inward to narrow the mouth of hook 52*b*, such that hook tip 55*b* is capable of preventing hook 52*b* from snagging, poking, etc., and such that hook 52*b* is capable of securely fastening a loop section thereon when the loop section is hooked thereon, regardless of the tension of the loop section (for example, the loop section can be on a worn or unworn footwear, and the tension of the loop section can be loose or tight or anywhere in between).

Releasably locking device 54 is:

1) For quickly and easily locking hook 52*a* of loop-section fastener 51 on a loop section, to quickly and easily fasten loop-section fastener 51 on the loop section, and
2) For quickly and easily releasing hook 52*a* of loop-section fastener 51 from a loop section, to quickly and easily unfasten loop-section fastener 51 from the loop section.

Releasably locking device 54 is for releasably locking hook 52*a* of loop-section fastener 51 on at least one loop section, quickly and easily.

Loop-section fastener 51 is for at least one loop section to be fastened thereon and for at least one loop section to be unfastened therefrom to fasten a footwear on and to unfasten a footwear from a foot, respectively.

Operation

Figure 5:
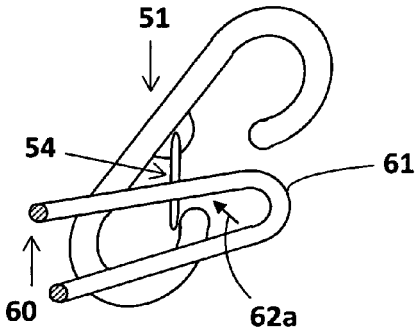
FIGS. 5, 6, 7, and 8 illustrate how to lock and release a loop section on and from a loop-section fastener, respectively.
Figure 6:
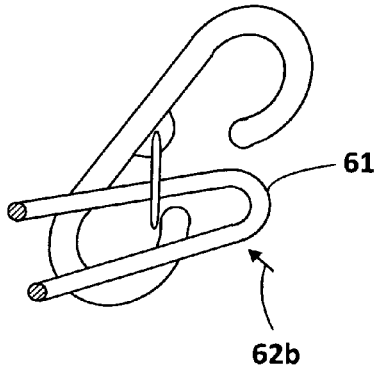
Figure 7:
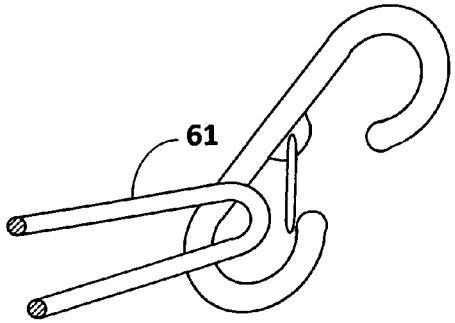

FIGS. 5, 6, and 7 illustrate a method for quickly and easily locking hook 52*a* of loop-section fastener 51 on a loop section, and another method for quickly and easily releasing hook 52*a* of loop-section fastener 51 from a loop section. A loop 60 has a loop section 61:

1) To quickly and easily lock hook 52*a* of loop-section fastener 51 on loop section 61 (FIGS. 5 and 6):
   - push loop section 61 against releasably locking device 54 (in the direction of arrow 62*a*) such that releasably locking device 54 opens, and
   - push loop section 61 past releasably locking device 54 (in the direction of arrow 62*a*) such that releasably locking device 54 closes.
2) To quickly and easily release hook 52*a* of loop-section fastener 51 from loop section 61 (FIGS. 6 and 7):
   - push loop section 61 against releasably locking device 54 (in the direction of arrow 62*b*) such that releasably locking device 54 opens, and
   - push loop section 61 past releasably locking device 54 (in the direction of arrow 62*b*) such that releasably locking device 54 closes.

Figure 8:
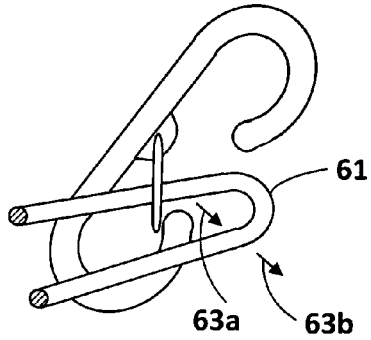

FIG. 8 illustrates two methods equivalent to the two above-described methods, respectively:

1) To quickly and easily lock hook 52*a* of loop-section fastener 51 on loop section 61:
   - push releasably locking device 54 against loop section 61 (in the direction of arrow 63*a*) such that releasably locking device 54 opens, and
   - push releasably locking device 54 past loop section 61 (in the direction of arrow 63*a*) such that releasably locking device 54 closes.
2) To quickly and easily release hook 52*a* of loop-section fastener 51 from loop section 61:
   - push releasably locking device 54 against loop section 61 (in the direction of arrow 63*b*) such that releasably locking device 54 opens, and
   - push releasably locking device 54 past loop section 61 (in the direction of arrow 63*b*) such that releasably locking device 54 closes.

FIRST EXAMPLE

Structure

Figure 9:
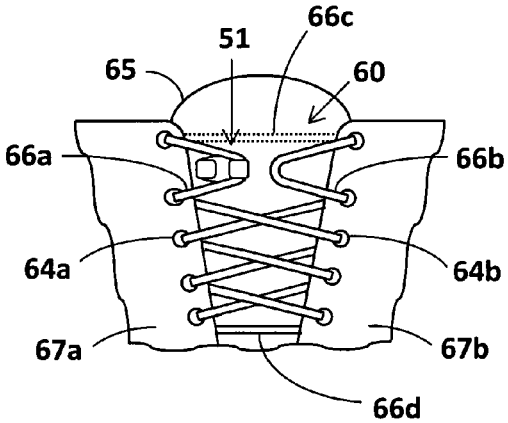
FIGS. 9, 10, and 11 illustrate a unique system with a loop-section fastener having a releasably locking device.
Figure 10:
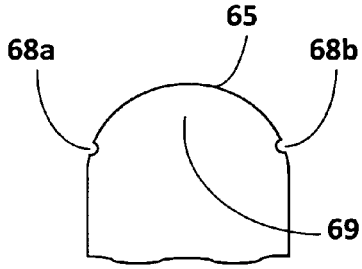

FIGS. 9 and 10 illustrate a unique system for fastening a footwear on a foot. The unique system comprises loop-section fastener 51 (illustrated in FIGS. 1-8), loop 60 (illustrated in FIGS. 5-8), a plurality of opposite loop receivers 64*a* and 64*b* of a footwear, and a tongue 65 of the footwear. Loop 60 has a predetermined length to set predetermined loop tension(s). Loop 60 has two opposite loop sections 66*a* and 66*b* and two central loop sections 66*c* and 66*d*. The footwear has two opposite sides 67*a* and 67*b*, on which opposite loop receivers 64*a* and 64*b* are disposed, respectively. Tongue 65 has two opposite openings 68*a* and 68*b*, a tongue top 69, and outer and inner surfaces. Each of two opposite openings 68*a* and 68*b* extends from the outer surface to the inner surface of tongue 65.

The footwear is laced with loop 60, such that each of loop sections 66*a* and 66*b* extends between two of loop-receivers 64*a* and 64*b* on the same side, and such that central loop section 66*c* extends between two opposite openings 68*a* and 68*b* of tongue 65 and hides inside tongue 65. Releasably locking device 54 of loop-section fastener 51 is pushed against and past loop section 66*a* to releasably lock hook 52*a* of loop-section fastener 51 on loop section 66*a*, quickly and easily, to fasten loop-section fastener 51 on loop section 66*a* (see the example in FIGS. 5, 6, 7, and 8 above).

Material

The material(s), used to make each component of the unique system, can partially or entirely be rigid, non-rigid, flexible, non-flexible, pliable, non-pliable, elastic, non-elastic, resilient, non-resilient, etc. . . . , or a combination of at least two of the above. For example, the material, used to make each component of the unique system, can partially or entirely be leather, vinyl, nylon, cotton, wool, fabric, foam, plastic, plastic composite, plasticized material, Zytel nylon, neon material, glow-in-the-dark material, fluorescent material, glittering material, light-reflecting material, rubber, steel, aluminum, alloy, titanium, bronze, iron, zinc, tin, copper, metal, carbon fiber, the like, the equivalent, etc. . . . , or a combination of at least two of the above.

Operation

Figure 11:
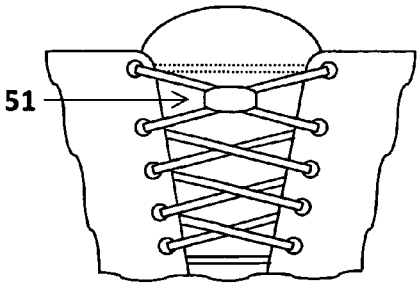

FIGS. 9, 10, and 11 illustrate two unique methods for fastening and unfastening the footwear on and from a foot, respectively. After inserting a foot into the footwear:

1) To fasten the footwear on the foot, hook loop section 66*b* on hook 52*b* of loop-section fastener 51, to fasten loop section 66*b* on loop-section fastener 51.
2) To unfasten the footwear from the foot, unhook loop section 66*b* from hook 52*b* of loop-section fastener 51, to unfasten loop section 66*b* from loop-section fastener 51.
   (For example, to unhook loop section 66*b* from hook 52*b*, a person can lift hook 52*b* with one finger until loop section 66*b* slides off hook 52*b*).

Advantages

Referring to FIG. 11, when the unique system fastens the footwear on the foot, it fastens the two top opposite ones of opposite loop receivers 64*a* and 64*b* right on top of two opposite openings 68*a* and 68*b* of tongue 65, respectively (with central loop section 66*c* extending inside tongue 65 between two opposite openings 68*a* and 68*b* of tongue 65). As a result, at the same time, the unique system:

1) Automatically lifts tongue 65 at tongue top 69 to straighten the whole tongue 65, resulting from loop 60 threaded through the two top opposite ones of opposite loop receivers 64*a* and 64*b* and through two opposite openings 68*a* and 68*b* at tongue top 69, which eliminates the problem of tongue top 69 sagging, at every step;
2) Automatically centers tongue 65 between two opposite sides 67*a* and 67*b*, resulting from loop 60 threaded through the two top opposite ones of opposite loop receivers 64*a* and 64*b* and through two opposite openings 68*a* and 68*b* at tongue top 69, which eliminates the problem of the foot becoming unprotected and exposed, at every step;
3) Automatically locks tongue 65 between two opposite sides 67*a* and 67*b*, resulting from loop 60 threaded through the two top opposite ones of opposite loop receivers 64*a* and 64*b* and through two opposite openings 68*a* and 68*b* at tongue top 69, which eliminates the problem of tongue 65 sliding sideways, at every step;
4) Automatically interlocks tongue 65 and two opposite sides 67*a* and 67*b*. As a result, the more two opposite sides 67*a* and 67*b* are pulled apart, the more securely they are locked together, which eliminates the problem of the footwear warping, at every step;
5) Automatically interlocks tongue 65 and two opposite loop sections 66*a* and 66*b*. As a result, the more two opposite loop sections 66*a* and 66*b* are pulled apart, the more securely they are locked together, which eliminates the problem of using hazardous messy bows and lace ends, the problem of tying and untying every time the footwear is worn, and the problem of re-tying and re-untying every time the bows become loose; and
6) Automatically fastens the footwear at predetermined loop tension(s) of loop 60, which eliminates the problems of adjusting and re-adjusting the tension of a conventional lace every time the footwear is fastened on the foot, and eliminates the problems of guessing and searching for 'the' favorite tension of a conventional lace every time the footwear is fastened on the foot.

Figure 12:
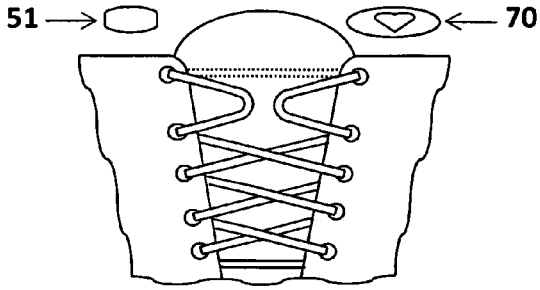
FIG. 12 illustrates a loop-section fastener, which can be, quickly and easily, released from a loop section, to be replaced with another loop-section fastener.

FIG. 12 illustrates the unique capabilities of releasably locking device 54 (see the example in FIG. 4 above) of loop-section fastener 51, which allows loop-section fastener 51:

1) To be locked on the loop section of a loop, quickly and easily, without the needs for taking the loop apart;
2) To be released from the loop section of a loop, quickly and easily, without the needs for taking the loop apart;
3) To be worn upside down or right side up, quickly and easily, without the needs for taking the loop apart;
4) To be removed to add decoration or device to it, quickly and easily, without the needs for taking the loop apart;
5) To be interchanged with another loop-section fastener, quickly and easily, without the needs for taking the loop apart;
6) To be replaced with another loop-section fastener, quickly and easily, without the needs for taking the loop apart, for example, of:
   a) Different design for different mood, fashion, etc.,
   b) Different length for different loop tension, etc.,
   c) Different shape for additional capability, etc.,
   d) Different material for different capability, etc.

For example, loop-section fastener 51 can quickly and easily be replaced with a loop-section fastener 70, which is similar to and equivalent to loop-section fastener 51. Loop-section fastener 70 has a relief of a heart integrated thereinto for decoration and for making the surface of loop-section fastener 70 non-slippery. To quickly and easily replace loop-section fastener 51 with loop-section fastener 70:

1) Push loop section 66*a* against and past releasably locking device 54 of loop-section fastener 51 (see the example in FIGS. 6 and 7 above) to quickly and easily release loop section 66*a* from loop-section fastener 51, and
2) Push loop section 66*a* against and past a releasably locking device of loop-section fastener 70 (see the example in FIGS. 5 and 6 above) to quickly and easily lock loop section 66*a* on loop-section fastener 70.

EQUIVALENTS

Figure 13:
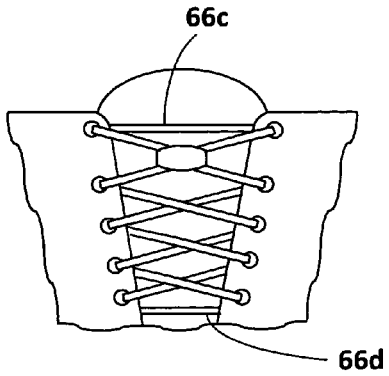
FIGS. 13 and 14 illustrate the unique system having its two opposite loop receivers replaced with two opposite hooks.

FIG. 13 illustrates a unique system, which is equivalent to and comprises the unique system in the first example. Wherein, loop 60 has two central loop sections 66*c* and 66*d*:

1) Either one or both of central loop sections 66*c* and 66*d* can be inside or outside tongue 65, and/or
2) Either one or both of central loop sections 66*c* and 66*d* can be fastened to the footwear (for example, sewn, clamped, riveted, glued, etc. . . . to at least one of two opposite sides 67*a* and 67*b* and/or to tongue 65).

Figure 14:
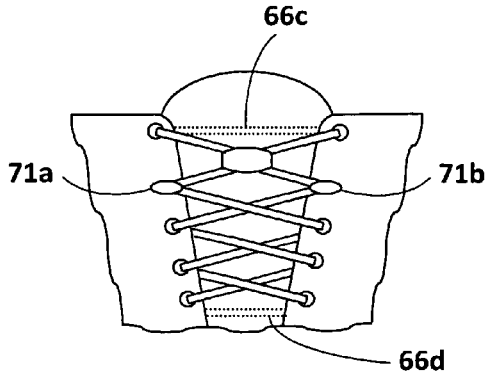

FIG. 14 illustrates a unique system, which is equivalent to and comprises the unique system in the first example. Wherein, loop 60 has two central loop sections 66*c* and 66*d*:

1) Either one or both of central loop sections 66*c* and 66*d* can be inside or outside tongue 65,
2) Either one or both of central loop sections 66*c* and 66*d* can be fastened to the footwear (for example, sewn, clamped, riveted, glued, etc. . . . to at least one of two opposite sides 67*a* and 67*b* and/or to tongue 65), and/or
3) Two of opposite loop receivers 64*a* and 64*b* can be replaced with two opposite hooks 71*a* and 71*b*, each of which is equivalent to either one of two opposite hooks 52*a* and 52*b* of loop-section fastener 51, such that at least one loop section of loop 60 can be fastened thereon and at least one loop section of loop 60 can be unfastened therefrom to fasten the footwear on and to unfasten the footwear from a foot, respectively.

Figure 15:
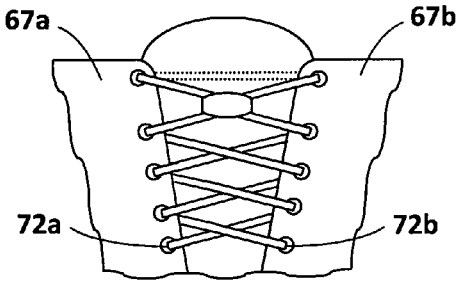
FIGS. 15, 16, 17, and 18 illustrate a loop being replaced with a lace, whose two lace ends can be fastened to a footwear or to each other to turn the lace into a loop.
Figure 16:
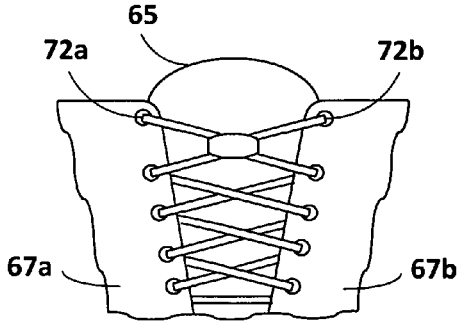
Figure 17:
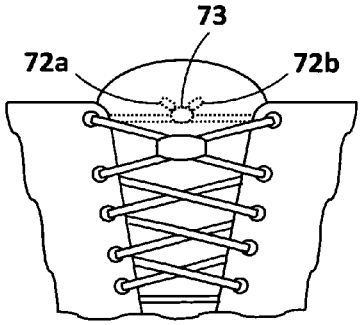
Figure 18:
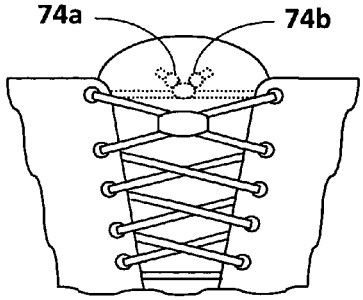

FIGS. 15, 16, 17, and 18 illustrate a unique system, which is equivalent to and comprises the unique system in the first example. Wherein, loop 60 can be replaced with a lace having two lace ends 72*a* and 72*b*, which can be:

1) Fastened to the footwear, to turn the lace into a loop equivalent to loop 60. For example:
   a) Weaved, sewn, clamped, riveted, glued, etc. . . . to at least one of two opposite sides 67*a* and 67*b* and/or to tongue 65 (FIGS. 15 and 16), b) Tied to at least one of two opposite sides 67*a* and 67*b* and/or to tongue 65 such that two lace ends 72*a* and 72*b* are fastened to at least one of two opposite sides 67*a* and 67*b* and/or to tongue 65 (FIGS. 15 and 16), c) Threaded through two of opposite loop receivers 64*a* and 64*b*, respectively, and tied separately into at least one knot such that each of two lace ends 72*a* and 72*b* is fastened to one of two opposite sides 67*a* and 67*b*. The lace can be partially or entirely inside or outside tongue 65, or d) Weaved, sewn, clamped, riveted, glued, etc. . . . to the top layer of tongue 65, to the bottom layer of tongue 65, to both the top and bottom layers of tongue 65, or to both the top and bottom layers of tongue 65 at the seam(s) where the top and bottom layers of tongue 65 are fastened together (FIGS. 15 and 16);

2) Fastened to each other, to turn the lace into a loop equivalent to loop 60. For example:

a) Weaved, sewn, clamped, riveted, glued, etc. . . . together, b) Tied together such that they are fastened to each other, c) Tied together into a square knot 73 such that they are fastened to each other (FIG. 17), or d) Tied together into square knot 73 and, then, tied separately into opposite knots 74*a* and 74*b*, respectively, such that they are fastened to each other (FIG. 18);

3) Inside or outside tongue 65; and/or

4) A combination of at least two of the above.

Lace ends 72*a* and 72*b* can be refastened any time to reset the predetermined tensions of the lace. To untie square knot 73, hold lace portions on the opposite sides of square knot 73, and pull the lace portions and one of two lace ends 72*a* and 72*b* in opposite directions.

If desired, this unique systems can have a tongue, equivalent to and replacing tongue 65. This tongue can have at least one opening. One or each of lace ends 72*a* and 72*b* of the lace can be threaded through at least one of the at least one opening of this tongue.

Figure 19:
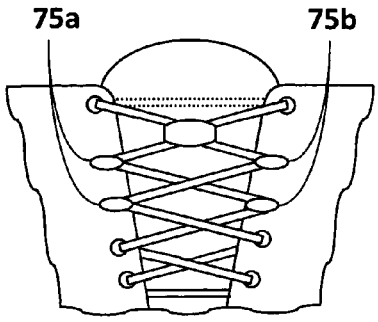
FIGS. 19 and 20 illustrate at least one ring and/or loop-section fastener being able to be replaced with at least one hook.

FIG. 19 illustrates a unique system, which is equivalent to and comprises the unique system in the first example. Wherein, at least one of opposite loop receivers 64*a* and 64*b* can be replaced with at least one of opposite hooks 75*a* and 75*b*, each of which is equivalent to either one of two opposite hooks 52*a* or 52*b* of loop-section fastener 51, such that at least one loop section of loop 60 can be fastened thereon and at least one loop section of loop 60 can be unfastened therefrom to fasten the footwear on and to unfasten the footwear from a foot, respectively.

Figure 20:
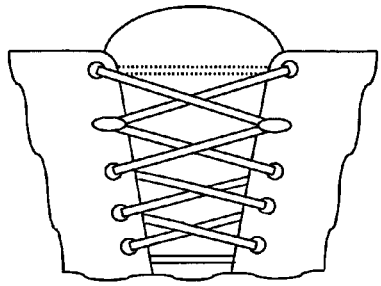

FIG. 20 illustrates a unique system, which is equivalent to and comprises the unique system in the first example. Wherein, at least one of opposite loop receivers 64*a* and 64*b* and loop-section fastener 51 can be replaced with at least one of opposite hooks, each of which is equivalent to either one of two opposite hooks 52*a* or 52*b* of loop-section fastener 51, such that at least one loop section of loop 60 can be fastened thereon and at least one loop section of loop 60 can be unfastened therefrom to fasten the footwear on and to unfasten the footwear from a foot, respectively.

Figure 21:
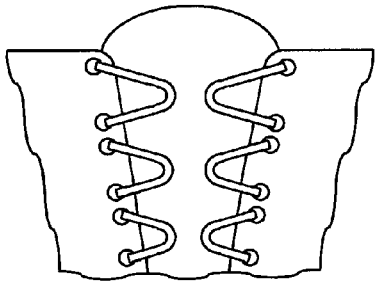
FIGS. 21 and 22 illustrate the unique system having a plurality of loop-section fasteners.
Figure 22:
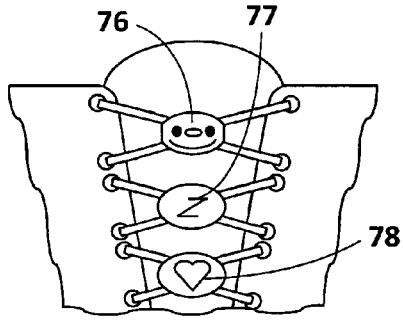

FIGS. 21 and 22 illustrate a unique system, which is equivalent to and comprises the unique system in the first example. Wherein, the footwear can be laced with loop 60, such that loop 60 has a plurality of opposite loop sections. Further, loop-section fastener 51 can be replaced with a plurality of loop-section fasteners such as those illustrated, which have a relief 76, an etched design 77, and a gem 78 integrated thereinto, respectively. Each of the loop-section fasteners is equivalent to loop-section fastener 51, such that it can be locked on and released from loop 60, quickly and easily, and such that at least one loop section of loop 60 can be fastened thereon and at least one loop section of loop 60 can be unfastened therefrom to fasten the footwear on and to unfasten the footwear from a foot, respectively.

Figure 23:
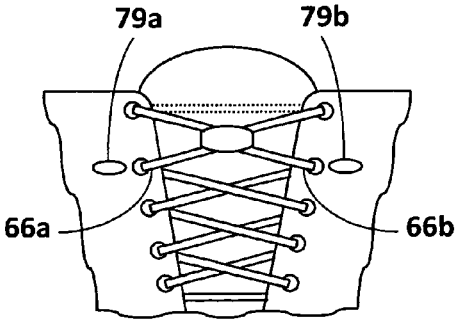
FIGS. 23, 24, 25, 26, 27, and 28 illustrate the unique system having a plurality of tension-adjusting hooks.

FIG. 23 illustrates a unique system, which is equivalent to and comprises the unique system in the first example. Further, this unique system comprises two opposite tension-adjusting hooks 79*a* and 79*b*. Each of two opposite tension-adjusting hooks 79*a* and 79*b* is equivalent to either one of two opposite hooks 71*a* and 71*b* in FIG. 14, is disposed at a predetermined location on one of two opposite sides 67*a* and 67*b*, and is for at least one loop section of loop 60 to be fastened thereon to adjust the tension of loop 60 (for example, to adjust to a higher or lower tension of loop 60).

Figure 24:
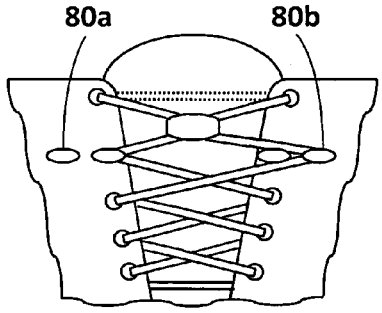

FIG. 24 illustrates a unique system, which is equivalent to and comprises the unique system in FIG. 14. Further, this unique system comprises two opposite tension-adjusting hooks 80*a* and 80*b*. Each of two opposite tension-adjusting hooks 80*a* and 80*b* is equivalent to either one of two opposite hooks 71*a* and 71*b* in FIG. 14, is disposed at a predetermined location on one of two opposite sides 67*a* and 67*b*, and is for at least one loop section of loop 60 to be fastened thereon to adjust the tension of loop 60 (for example, to adjust to a higher or lower tension of loop 60).

Figure 25:
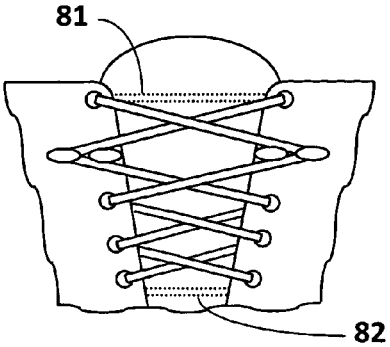

FIG. 25 illustrates a unique system, which is equivalent to and functions similarly to either one of the unique systems in FIGS. 23 and 24. Any one of opposite loop receivers can be replaced with a hook. The loop of the unique system has two central loop sections 81 and 82, either one or both of which can be inside or outside the tongue of the unique system.

Figure 26:
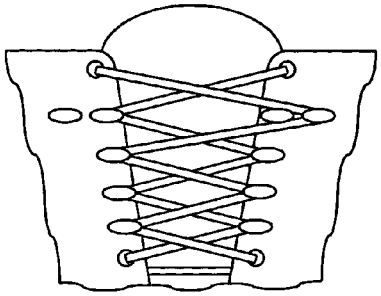

FIG. 26 illustrates a unique system, which is equivalent to and functions similarly to either one of the unique systems in FIGS. 23 and 24. Any one of opposite loop receivers can be replaced with a hook. The loop of the unique system can be replaced with a lace having two lace ends. Similar to two lace ends 72*a* and 72*b* in FIGS. 15, 16, 17, and 18, the two lace ends can be fastened to a footwear, fastened to each other, and/or inside or outside a footwear tongue.

Figure 27:
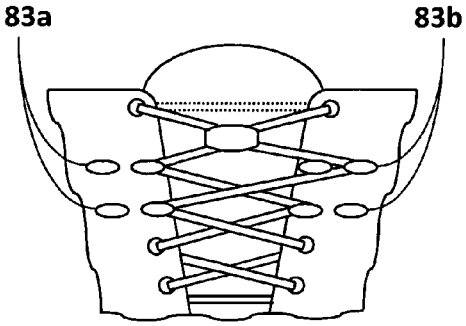

FIG. 27 illustrates a unique system, which is equivalent to and functions similarly to either one of the unique systems in FIGS. 25 and 26. The unique system has a plurality of opposite tension-adjusting hooks 83*a* and 83*b*. Each of opposite tension-adjusting hooks 83*a* and 83*b* is equivalent to either one of two opposite tension-adjusting hooks 80*a* and 80*b* in FIG. 24, is disposed at a predetermined location on one of two opposite sides of a footwear, and is for at least one loop section to be fastened thereon to adjust the tension of a loop (for example, to adjust to a higher or lower tension of a loop).

Figure 28:
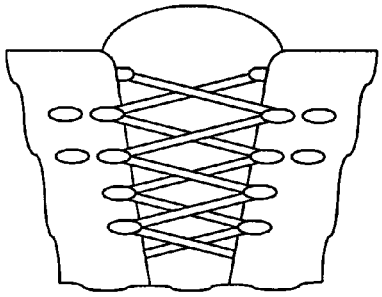

FIG. 28 illustrates a unique system, which is equivalent to and functions similarly to either one of the unique systems in FIGS. 25 and 26. The unique system has a plurality of opposite tension-adjusting hooks. Each of opposite tension-adjusting hooks is equivalent to either one of two opposite tension-adjusting hooks 80*a* and 80*b* in FIG. 24, is disposed at a predetermined location on one of two opposite sides of a footwear, and is for at least one loop section to be fastened thereon to adjust the tension of a loop (for example, to adjust to a higher or lower tension of a loop).

Figure 29:
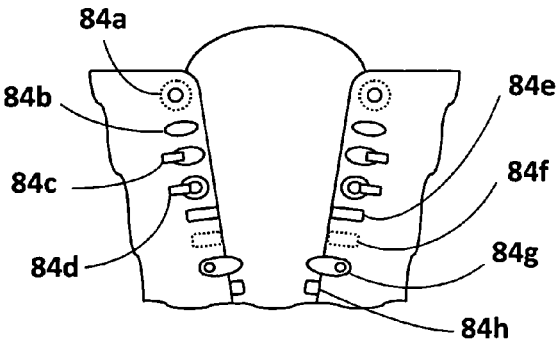
FIGS. 29 and 30 illustrate examples of conventional loop receivers.

FIG. 29 illustrates some examples of conventional loop receivers, any of which can be used in any unique system of the invention. A conventional loop receiver can be:

1) A ring 84*a* (represented by the dotted circle), which is a portion of a side of a footwear;

2) An upside-down or right-side-up hook 84*b*, fastened to the upper side of a footwear;

3) A rotatable and/or flippable hook 84*c*, fastened to the upper side of a footwear;

4) A rotatable and/or flippable ring 84*d*, fastened to the upper side of a footwear;
5) A flexible and/or pliable ring 84*e*, fastened to the upper side of a footwear;
6) A flexible and/or pliable ring 84*f*, fastened to the underside of a footwear;
7) A rotatable and/or flippable ring 84*g*, fastened to the upper side of a footwear; and
8) A flexible and/or pliable ring 84*h*, fastened to the edge of a side of a footwear.

Figure 30:
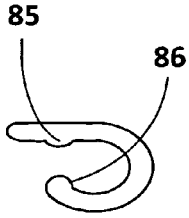

FIG. 30 illustrates an example of conventional loop receivers, which is a hook and can be used in any unique system of the invention. The hook has a predetermined mound 85 and tip 86, each of which is equivalent to and functions similarly to either one of two opposite hook tips 55*a* and 55*b* in FIG. 1, such that either one of mound 85 and tip 86 is capable of preventing the hook from snagging, poking, etc., and/or such that the hook is capable of securely fastening a loop section thereon when the loop section is hooked thereon, regardless of the tension of the loop section.

Figure 31:
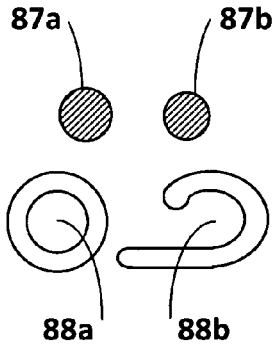
FIGS. 31 and 32 illustrate two examples of loop receivers, each of which lets a loop section slide therethrough freely or restrictedly.
Figure 32:
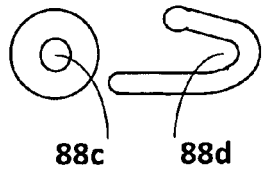

FIGS. 31 and 32 illustrate two cross-sections 87*a* and 87*b* of two loop sections, respectively:
1) Two loop receivers (which are a ring and a hook and can be used in any unique system of the invention) have two predetermined (for example, large) openings 88*a* and 88*b*, respectively, to let the two loop sections slide therethrough freely.
2) Two loop receivers (which are a ring and a hook and can be used in any unique system of the invention) have two predetermined (for example, small) openings 88*c* and 88*d*, respectively, to let the two loop sections slide therethrough restrictedly.

Figure 33:
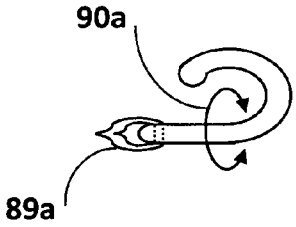
FIGS. 33, 34, 35, and 36 illustrate examples of rotatable and/or flippable loop receivers.
Figure 34:
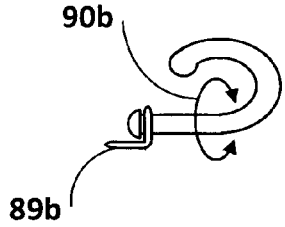

FIGS. 33 and 34 illustrate two loop receivers, each of which is a rotatable and/or flippable hook and can be used in any unique system of the invention. Each of the hooks can have, for example, a fabric ring 89*a* or a metallic ring 89*b*, and can rotate 360 degrees in either one of the opposite directions of an arrow 90*a* or 90*b*.

Figure 35:
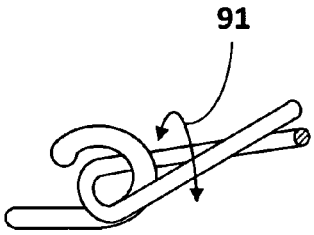
Figure 36:
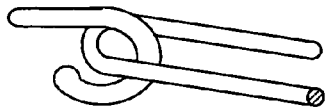

FIGS. 35 and 36 illustrate a loop section and a loop receiver. The loop receiver is a rotatable and/or flippable hook and can be used in any unique system of the invention. The loop section and the hook each can rotate independently in either one of the opposite directions of an arrow 91 before or after hooked on each other to adjust to a higher or lower tension of a loop, such that:
1) The loop section can be worn twisted or untwisted, and/or
2) The hook can be worn upside down or right side up.

Figure 37:
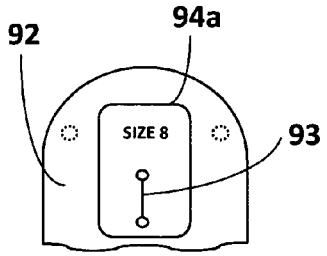
FIGS. 37 and 38 illustrate examples of a footwear tongue having means for preventing its bottom layer from fraying.
Figure 38:
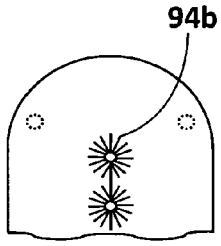

FIGS. 37 and 38 illustrate a tongue, equivalent to tongue 65 in the first example (FIG. 10). The tongue has a top layer, two opposite openings in the top layer, a bottom layer 92, and a dumb-bell-shaped opening 93 in bottom layer 92, for example, as illustrated or at the top of the tongue. A vinyl tag 94*a* (FIG. 37) can be heat-glued on bottom layer 92 and around the edge of opening 93 or a regular or elastic thread 94*b* (FIG. 38) can be sewn on bottom layer 92 and around the edge of opening 93, to reinforce bottom layer 92 to prevent it from fraying around the edge of opening 93. Opening 93 extends from the inner surface of bottom layer 92 to the outer surface of vinyl tag 94*a*. Referring to the unique system in FIGS. 17 and 18, loop 60 can be replaced with a lace having two lace ends 72*a* and 72*b*. Equivalently, to fasten two lace ends 72*a* and 72*b* to each other, each of two lace ends 72*a* and 72*b* can be threaded separately through one of two opposite openings in the top layer, and threaded together through opening 93. Then, two lace ends 72*a* and 72*b* can be tied together such that they are fastened to each other, and hidden inside the tongue top and prevented from moving and/or sliding down.

Figure 39:
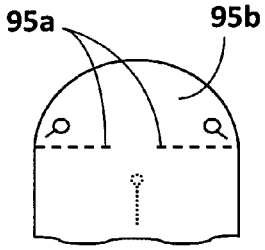
FIGS. 39, 40, 41, and 42 illustrate examples of a footwear tongue having compartmentalizing device(s) for creating a compartment therein.

FIG. 39 illustrates a tongue, which is equivalent to and functions similarly to the tongue in FIG. 37 or 38. The tongue has two pendulum-shaped openings in its top layer, a pendulum-shaped opening in its bottom layer, and threads 95*a*. Threads 95*a* can sew the top and bottom layers of the tongue together to create a compartment 95*b* therebetween for hiding a loop section, lace ends, and/or a lace-end fastener, and for preventing them from moving and/or sliding down. Threads 95*a* can be replaced with any fastening device, for example, glue, rivet, velcro, snap lock, the like, the equivalent, etc.

Figure 40:
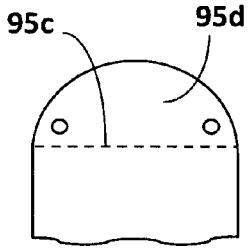

FIG. 40 illustrates a tongue, which is equivalent to and functions similarly to tongue 65 in the first example (FIG. 10). The tongue has two openings in its top layer and a thread 95*c*. Thread 95*c* can sew the top and bottom layers of the tongue together to create a compartment 95*d* therebetween for hiding a loop section, lace ends, and/or a lace-end fastener, and for preventing them from moving and/or sliding down. Thread 95*c* can be replaced with any fastening device, for example, glue, rivet, velcro, snap lock, the like, the equivalent, etc.

Figure 41:
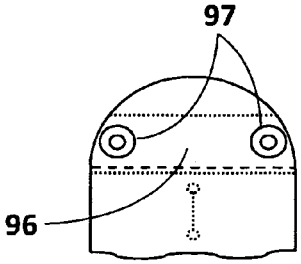

FIG. 41 illustrates a tongue, which is equivalent to and functions similarly to the tongue in FIG. 37 or 38. The tongue has two openings in its top layer, a dumb-bell-shaped opening in its bottom layer, and a predetermined inside layer 96 inside the tongue. The two openings can have two grommets 97 attached to their edges to reinforce their edges to prevent them from fraying, respectively. The edges of the bottom and the sides of predetermined inside layer 96 can be sewn to the top and/or bottom layers of the tongue to create a compartment therein for hiding a loop section, lace ends, and/or a lace-end fastener, and for preventing them from moving and/or sliding down.

Figure 42:
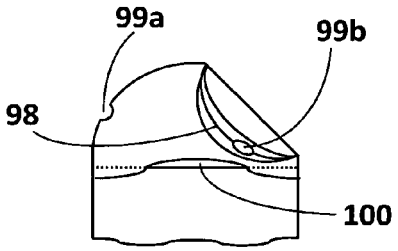

FIG. 42 illustrates a tongue, which is equivalent to and functions similarly to the tongue in FIG. 37 or 38. The tongue has a seam 98, two opposite openings 99*a* and 99*b*, and a horizontal opening 100 in its bottom layer. The top and bottom layers of the tongue are fastened to each other along seam 98. Two opposite openings 99*a* and 99*b* are in seam 98. Opening 100 is covered partially or entirely by a portion of the bottom layer of the tongue.

Figure 43:
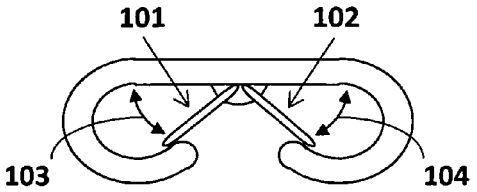
FIGS. 43 and 44 illustrate variations of the loop-section fastener.

FIG. 43 illustrates a loop-section fastener, which is equivalent to and functions similarly to loop-section fastener 51 in the first example (FIG. 4). The loop-section fastener has two opposite releasably locking devices 101 and 102, each of which is identical to and functions similarly to releasably locking device 54 of loop-section fastener 51 in FIGS. 9 and 11 in the first example. Equivalently, two opposite releasably locking devices 101 and 102 can pivot in either one of the opposite directions of arrows 103 and 104, respectively, to open or close the mouths of the two opposite hooks of the loop-section fastener, respectively.

Figure 44:
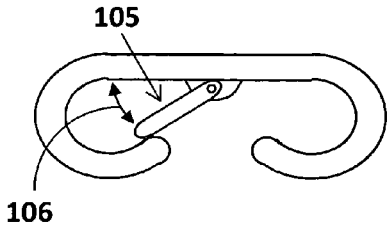

FIG. 44 illustrates a loop-section fastener, which is equivalent to and functions similarly to loop-section fastener 51 in the first example (FIG. 4). The loop-section fastener has a spring-loaded releasably locking device 105, which is equivalent to and functions similarly to releasably locking device 54 of loop-section fastener 51 in FIGS. 9 and 11 in the first example. Equivalently, spring-loaded releasably locking device 105 can pivot in either one of the opposite directions of an arrow 106 to open or close the mouth of the respective hook of the loop-section fastener.

Figure 45:
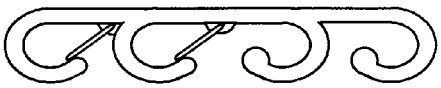
FIGS. 45 and 46 illustrate examples of loop-section fastener having loop-tension-adjusting capability.

FIG. 45 illustrates a loop-section fastener, which is equivalent to and functions similarly to loop-section fastener 51 in the first example (FIG. 4). The loop-section fastener can have a plurality of opposite tension-adjusting hooks and releasably locking devices. Each of the opposite tension-adjusting hooks is equivalent to either one of two opposite hooks 71*a* and 71*b* in FIG. 14, and is for at least one loop section of a loop to be fastened thereon to adjust the tension of the loop (for example, to adjust to a higher or lower tension of the loop).

For example, like any loop-section fastener of the invention, the loop-section fastener can be separate from or fastened to a footwear, the tongue of a footwear, etc. . . . upside down or right side up.

Figure 46:
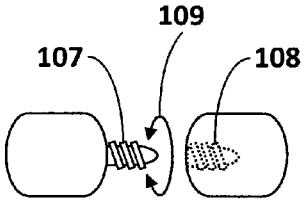

FIG. 46 illustrates the top view of a loop-section fastener, which is similar to loop-section fastener 51 in the first example (FIG. 4), except that its two opposite hooks are separate from each other. Its two opposite hooks have a screw 107 and a mating threaded recess 108 integrated thereinto, respectively, and can rotate in either one of the opposite directions of an arrow 109 to lengthen or shorten the length of the loop-section fastener. The loop-section fastener is equivalent to and functions similarly to the loop-section fastener in FIG. 45, to adjust the tension of a loop.

Figure 47:
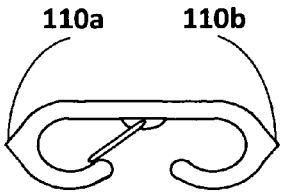
FIG. 47 illustrates a loop-section fastener having at least one relief for making its surface(s) non-slippery.

FIG. 47 illustrates a loop-section fastener, which is equivalent to and functions similarly to loop-section fastener 51 in the first example (FIG. 4). The loop-section fastener can have at least one relief, for example, of ridge(s) 110*a* and 110*b*, mound(s), groove(s), recess(es), the like(s), the equivalent(s), or a combination of at least two of the above) integrated into its surface(s) at predetermined location(s) for making its surface(s) non-slippery such that, for example, the loop-section fastener can be held and operated securely by a person.

Figure 48:
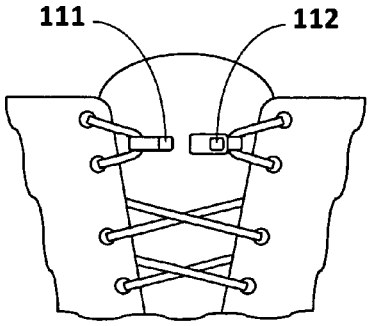
FIG. 48 illustrates an equivalent snap-locking loop-section fastener.

FIG. 48 illustrates a loop-section fastener, which is equivalent to and functions similarly to loop-section fastener 51 in the first example (FIG. 4). The loop-section fastener has two opposite hooks separate from each other. Its two opposite hooks have a snap hook 111 and a mating hole 112 integrated thereinto, respectively, which can snap-lock together.

Figure 49A:
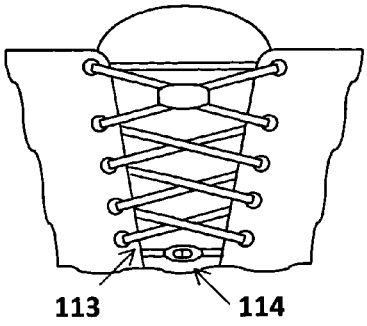
FIGS. 49A, 49B, 49C, and 49D illustrate the unique system having a lace-end fastener for fastening two lace ends of a lace to each other to turn the lace into a loop.
Figure 49B:
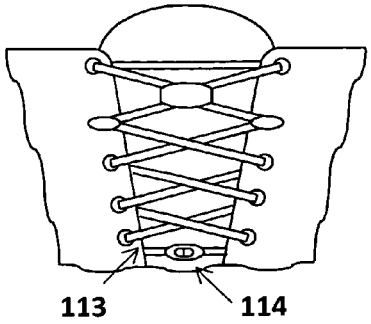
Figure 49C:
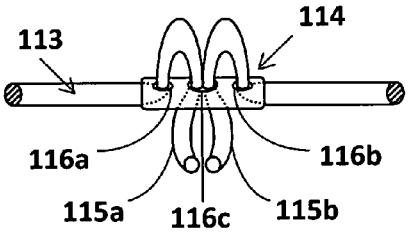

FIGS. 49A, 49B, and 49C illustrate two unique systems, each of which is equivalent to and functions similarly to any of the unique systems and their equivalents of the invention. Each of these two unique systems comprises loop-section fastener 51 in the first example (FIG. 4), a lace 113, a plurality of opposite loop receivers of a footwear, and a lace-end fastener 114. Lace 113 has two lace ends 115*a* and 115*b*. Lace-end fastener 114 is for fastening two lace ends 115*a* and 115*b* to each other to turn lace 113 into a loop, which is equivalent to and functions similarly to loop 60 in the first example. Lace-end fastener 114 is equivalent to square knot 73 and/or knots 74*a* and 74*b* in FIGS. 17 and 18. The cross-section of any portion of lace-end fastener 114 can have any predetermined shape and size (for example, a C or O shape, the like, etc.).

FIG. 49C illustrates the upper side of lace-end fastener 114 (from FIGS. 49A and 49B) having two opposite fastening openings 116*a* and 116*b*, and a central fastening opening 116*c*. Each of two opposite fastening openings 116*a* and 116*b* and central fastening opening 116*c* has a predetermined shape and size, such that when lace 113 is threaded therethrough, lace 113 will be clamped and locked therein (for example, the diameter of each of two opposite fastening openings 116*a* and 116*b* and central fastening opening 116*c* can be smaller than that of the cross-section of lace 113). To fasten two lace ends 115*a* and 115*b* to each other to turn lace 113 into a loop equivalent to loop 60 in the first example, each of two lace ends 115*a* and 115*b* is threaded separately into one of two opposite ends of lace-end fastener 114, then, is threaded separately through one of two opposite fastening openings 116*a* and 116*b*, and then, is threaded together with the other one through central fastening opening 116*c*.

Figure 49D:
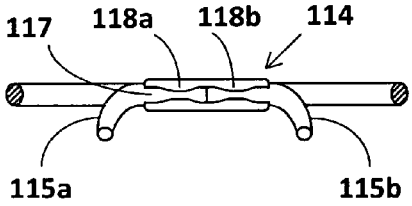

FIG. 49D illustrates the underside of lace-end fastener 114 (from FIGS. 49A and 49B) having a mouth 117, which runs the length of the underside of lace-end fastener 114. The edges of the underside along mouth 117 are shaped into two securing lips 118*a* and 118*b* at predetermined locations thereat.

To set lace 113 at a desired tension and to turn lace 113 into a loop after the unique systems was assembled as shown in FIG. 49A or 49B and a foot was inserted into the footwear:

1) Pull two lace ends 115*a* and 115*b* to a desired tension, and
2) Fold two lace ends 115*a* and 115*b* under two securing lips 118*a* and 118*b*, respectively, to secure them.
3) If desired, each or at least one of lace ends 115*a* and 115*b* can be tied separately or together into at least one knot.

Equivalent to each of the above-described methods for fastening two lace ends of a lace to each other to turn the lace into a loop, lace-end fastener 114 can fasten any two lace ends of a lace to each other to turn the lace into a loop, which is equivalent to and functions similarly to loop 60 in the first example and can replace any loop or lace of any of the unique systems and their equivalents of the invention.

Figure 50A:
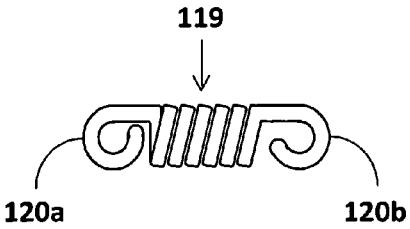
FIG. 50A illustrates an equivalent spring loop-section fastener.

Lace-end fastener 114 can also be used in any of the unique systems and their equivalents of the invention, whose loop-section fastener(s) can be replaced with at least one loop-section fastener, each of which can comprise or have at least one ring and/or at least one hook. For example, loop-section fastener 51 of the unique system in FIG. 49A or 49B can be replaced with a loop-section fastener (equivalent to loop-section fastener 51), which comprises the ring and hook in FIG. 31 integrated into each other. For another example, loop-section fastener 51 of the unique system in FIG. 49A or 49B can be replaced with a loop-section fastener (equivalent to loop-section fastener 51), which comprises a predetermined wire (for example, a flat, round, oval, or rectangular wire) having one end bent into a ring and another end bent into a hook. For another example, loop-section fastener 51 of the unique system in FIG. 49A or 49B can be replaced with a loop-section fastener (equivalent to loop-section fastener 51), which comprises a predetermined spring 119 in FIG. 50A having one end 120*a* bent into a ring and another end 120*b* bent into a hook.

CONCLUSION

Any of the unique systems and their equivalents of the invention can comprise at least one loop, at least one loop-section fastener, at least one lace, at least one lace-end fastener, at least one hook (which is a loop receiver of a footwear), at least one tension-adjusting hook (which is a loop receiver of a footwear), at least one ring (which is a loop receiver of a footwear), at least one tension-adjusting ring (which is a loop receiver of a footwear), and/or a combination of at least two of the above.

A loop, equivalent to the loop of any of the unique systems and their equivalents of the invention, can have at least one loop section. A lace, equivalent to the loop of any of the unique systems and their equivalents of the invention, can have at least one lace section.

Figure 50B:
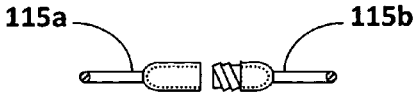
FIG. 50B illustrates an equivalent lace-end fastener.

Lace-end fastener 114 (FIGS. 49C and 49D), equivalent to square knot 73 and/or knots 74*a* and 74*b* (FIGS. 17 and 18) can have any shape and size, can have at least one securing lip of any shape and size, can have at least one fastening opening of any shape and size, can be outside or inside a tongue, and can be replaced with any equivalent. For example, FIG. 50B illustrates a lace-end fastener, equivalent to lace-end fastener 114. Equivalently, the lace-end fastener comprises two predetermined tubes having mating threads, respectively, such that one can screw on the other to fasten the tubes together.

Each of two lace ends 115*a* and 115*b* can be threaded through one of the tubes, and tied separately or together such that they are fastened therein.

Each of the two unique systems in FIG. 49A or 49B can further comprise the tongue of the illustrated footwear. The tongue can have at least one opening. One or each of lace ends 115*a* and 115*b* of lace 113 can be threaded through at least one of the at least one opening of the tongue. Lace-end fastener 114 and two lace ends 115*a* and 115*b* can be hidden inside the tongue and prevented from moving or sliding down.

A tongue, equivalent to tongue 65 in the first example, can have at least one opening, each of which can have any shape and size, and can be disposed at any location thereon in any direction. Loop 60 can be replaced with a lace having two lace ends. One or each of the two lace ends can be threaded through at least one of the at least one opening of the tongue.

The unique system can have at least one loop-section fastener. Each loop-section fastener can be separate from, attached to, or integrated to a footwear at any portion(s) thereof, can have any shape and size, and can fasten at least one loop section or at least one lace section thereon.

The unique system can have at least one loop, or can have at least one lace whose lace ends are fastened to a footwear or to each other such that the at least one lace turns into at least one loop.

The unique system can be used with any type of footwear, for example, sneaker, tennis shoe, skateboarding shoe, sports shoe, running shoe, walking shoe, cross-training shoe, basket-ball shoe, soccer shoe, dress shoe, boot, the like, the equivalent, etc. Any element(s) of the unique system can be made separate from, attached to, or integrated to any other element(s) of the unique system and/or a footwear, which the unique system is used with.

The unique system can, further, comprise at least one relief, at least one design, at least one printing, at least one painting, at least one stamping, at least one device, at least one inscription, at least one decal, at least one engraving, at least one embossing, at least one decor, at least one etching, at least one marking, at least one gem, at least one rock, or a combination of at least two of the above, which can be attached to or integrated into any element of the unique system. For example, a light-reflecting, glow-in-the-dark, neon, or glittering tape or a relief can be attached to or integrated into loop-section fastener 51 in the first example. For another example, loop-section fastener 51 in the first example can be made of or made from light-reflecting, glow-in-the-dark, neon, or glittering material(s).

A foot can be inserted into the footwear before or after lace ends 72*a* and 72*b* in FIGS. 15-18 are fastened to set the predetermined lace tensions of the lace. Lace ends 72*a* and 72*b* can be refastened any time to reset the predetermined lace tensions of the lace.

A loop-section fastener, equivalent to loop-section fastener 51 in the first example, can have or can comprise at least one hook, the like, the equivalent, or a combination of at least two of the above, which are made separately or integrally. Each hook is for at least one loop section of a loop or at least one lace section of a lace to be hooked thereon.

A loop-section fastener, equivalent to loop-section fastener 51 in the first example, can be made of the same material as the footwear and integrated into the footwear as part of the footwear.

Each loop receiver of any of the unique systems and their equivalents of the invention can be disposed at any portion of a footwear, for example, the topside, the edge, or the underside of one of the two opposite sides of the footwear. The footwear can be laced with a loop or lace in any way to define any opposite loop or lace sections respectively, and to form any lacing style, using some or all of its loop receivers.

SUMMARY OF MAJOR ADVANTAGES

The present invention substantially departs from the conventional concepts and designs of the prior arts. In doing so, the invention provides a unique system having many unique and significant advantages, as follows:

1) An object of the invention is that the loop-section fastener of the unique system can be locked, quickly and easily, on a loop without the need for taking the loop apart;
2) Another object of the invention is that the loop-section fastener of the unique system can be released, quickly and easily, from a loop without the need for taking the loop apart;
3) A further object of the invention is that the loop-section fastener of the unique system can be replaced, quickly and easily, on a loop without the need for taking the loop apart;
4) Another object of the invention is that the loop-section fastener of the unique system can be interchanged, quickly and easily, on a loop without the need for taking the loop apart;
5) Still another object of the invention is that the loop-section fastener of the unique system can have slip-preventing device(s) integrated into its surface (for example, to create wavy, hilly, or grainy surface) to prevent it from being slippery such that the loop-section fastener can be held and operated securely;
6) Another object of the invention is that the tension of the loop of the unique system can be adjustable;
7) A further object of the invention is that the unique system automatically fastens a footwear on a foot at at least one predetermined tension of the loop of the unique system, every time the footwear is fastened on a foot;
8) Another object of the invention is that the unique system automatically lifts the tongue of a footwear between the two opposite sides of the footwear at the level of the two top opposite loop-receivers of the footwear, every time the footwear is fastened on a foot;
9) Still another object of the invention is that the unique system automatically centers the tongue of a footwear between the two opposite sides of the footwear at the level of the two top opposite loop-receivers of the footwear, every time the footwear is fastened on a foot;
10) Another object of the invention is that the unique system automatically locks the tongue of a footwear between the two opposite sides of the footwear at the level of the two top opposite loop-receivers of the footwear, every time the footwear is fastened on a foot;
11) A further object of the invention is that the unique system automatically interlocks the tongue and the two opposite sides of a footwear at the level of the two top opposite loop-receivers of the footwear, every time the footwear is fastened on a foot;
12) Another object of the invention is that the unique system automatically interlocks the tongue of a footwear and the loop sections of the loop of the unique system at the level of the two top opposite loop-receivers of the footwear, every time the footwear is fastened on a foot;
13) Still another object of the invention is that the unique system can hide a loop section, lace ends, and/or lace-end fastener inside the tongue of a footwear and prevent them from moving;

14) Another object of the invention is that the unique system only needs to be assembled once to set at least one predetermined loop tension or lace tension, which can be reset any time;

15) A further object of the invention is that the unique system eliminates the needs for adjusting and/or tying a lace every time a footwear is fastened on a foot;

16) Another object of the invention is that the unique system eliminates the needs for adjusting and/or untying a lace every time a footwear is unfastened from a foot;

17) Still another object of the invention is that the unique system is inexpensive, compact, safe, and simple. Thus, it can be used by people of almost any age;

18) Another object of the invention is that the unique system applies an interlocking method. Thus, the harder it is pulled, the more securely it fastens a footwear on a foot;

19) A further object of the invention is that the unique system only needs one finger to be operated;

20) Another object of the invention is that the unique system creates a smooth and sophisticated profile for a footwear;

21) Still another object of the invention is that the unique system can also serve as a decoration for a footwear, for example, when partially or entirely powder-coated with attractive color; and 22) Another object of the invention is that the unique system can also serve as a safety system, for example, when partially or entirely made of light-reflecting material.

The unique systems and methods and their equivalents of the invention are capable of various: colors, classes, materials, variations, ramifications, equivalents, structures, materials, functions, operations, forms, dimensions, permutations, styles, alternatives, extensions, arrangements, applications, configurations, simplifications, additions, deletions, adaptations, modifications, substitutions, combinations, associations, etc. without departing from the scope of the invention.

The scope of the invention will be determined by the ensuing claims and their legal equivalents, rather than by the aforementioned exemplifications.

I claim:

1. A system comprising:

loop-receiving means of a footwear, the footwear having two opposite sides, said loop-receiving means disposed on said two opposite sides respectively;

a tongue of the footwear, said tongue having at least one opening and outer and inner surfaces, each of said at least one opening extending from said outer surface to said inner surface;

looping means, said looping means having a plurality of loop sections, the footwear laced with said looping means such that each of said loop sections extends between two of said loop-receiving means on the same side and such that said looping means is threaded through said at least one opening;

loop-section-fastening means, said loop-section-fastening means for at least one of said loop sections to be fastened thereon and for at least one of said loop sections to be unfastened therefrom to fasten the footwear on and to unfasten the footwear from a foot respectively; and at least one spring, said loop-section-fastening means having opposite sides and upper and lower recesses disposed thereon respectively, said at least one spring comprising uneven spring halves on intersecting planes respectively, said at least one spring having spring ends, said spring ends bent inwards and inserted into said upper and lower recesses respectively, said at least one spring for locking said loop-section-fastening means on and for releasing said loop-section-fastening means from said looping means;

whereby, the system able to lock said loop-section-fastening means on and able to release said loop-section-fastening means from said looping means without the needs for taking said looping means apart, the system able to fasten the footwear on a foot at at least one predetermined tension of said looping means, the system able to interlock said tongue with said two opposite sides, and the system able to lift, center, and lock said tongue between the two top opposite ones of said loop-receiving means.

2. The system of claim 1, wherein, said at least one spring selected from the group consisting of: at least one resilient c-shaped wire, at least one resilient v-shaped wire, at least one resilient predeterminedly-shaped wire, and at least one predetermined wire.

3. The system of claim 1, wherein, said looping means comprising lacing means and lace-end-fastening means, said lacing means having a plurality of lace ends, said lace ends fastened by a method selected from the group consisting of: said lace-end-fastening means fastening said lace ends to the footwear, said lace-end-fastening means fastening said lace ends together, said lace-end-fastening means comprising said lace ends tied together such that said lace ends are fastened together, and a combination of at least two of the above.

4. The system of claim 1, wherein, said looping means comprising lacing means having a plurality of lace ends, said lace ends fastened to the footwear.

5. The system of claim 1, wherein, said looping means comprising lacing means having a plurality of lace ends, said lace ends tied such that said lace ends are fastened together.

6. The system of claim 1, wherein, said loop-section-fastening means selected from the group consisting of: at least one hook, at least one ring, and a combination thereof.

7. The system of claim 1, wherein, said loop-receiving means selected from the group consisting of: at least one hook, at least one ring, and a combination thereof.

8. The system of claim 1, further, comprising slip-preventing means integrated into at least one element of the system for making said at least one element non-slippery.

9. The system of claim 1, further, said tongue comprising reinforcing means attached thereto for reinforcing said tongue.

10. The system of claim 1, further, said tongue comprising compartmentalizing means attached thereto for creating at least one compartment therein.

11. The system of claim 1, further, said loop-section-fastening means comprising an element integrated thereto, said element selected from the group consisting of: snag-preventing means for preventing said loop-section-fastening means from snagging, securing means for securing said looping means on said loop-section-fastening means, and a combination thereof.

12. The system of claim 1, further, comprising an element selected from the group consisting of: at least one relief, at least one design, at least one printing, at least one painting, at least one stamping, at least one device, at least one inscription, at least one decal, at least one engraving, at least one embossing, at least one decor, at least one etching, at least one marking, at least one gem, at least one rock, and a combination of at least two of the above.

13. The system of claim 1, wherein, said looping means comprising lacing means and lace-end-fastening means, said lacing means having a plurality of lace ends, said lace ends fastened by a method selected from the group consisting of:

said lace-end-fastening means fastening said lace ends to the footwear, said lace-end-fastening means fastening said lace ends to the footwear and hidden inside said tongue, said lace-end-fastening means fastening said lace ends together, said lace-end-fastening means fastening said lace ends together and hidden inside said tongue, said lace-end-fastening means comprising said lace ends tied together such that said lace ends are fastened together, said lace-end-fastening means comprising said lace ends tied together such that said lace ends are fastened together and hidden inside said tongue, and a combination of at least two of the above.

14. A method, providing a system and a footwear, the system comprising, loop-receiving means of the footwear, a tongue of the footwear, a lace, first and second hooks, and a spring, the footwear having two opposite sides, said loop-receiving means disposed on said two opposite sides respectively, said lace having first and second lace sections and two lace ends, the footwear laced with said lace such that each of said first and second lace sections extends between two of said loop-receiving means on the same side, said tongue having at least one opening and outer and inner surfaces, each of said at least one opening extending from said outer surface to said inner surface, said lace threaded through said at least one opening, said lace ends tied into at least one knot such that said lace ends are fastened together and hidden inside said tongue, said first and second hooks integrated to each other, said first hook having opposite sides and upper and lower recesses disposed thereon respectively, said spring comprising two uneven spring halves on two intersecting planes respectively, said spring having two spring ends, said two spring ends bent inwards and inserted into said upper and lower recesses respectively, the method comprising the steps of:

pushing said first lace section against said spring, and pushing said first lace section past said spring.

15. The method of claim 14, further, comprising the steps of:

pushing said first lace section against said spring, and pushing said first lace section past said spring.

16. The method of claim 14, further, comprising the step of hooking said second lace section on said second hook.

17. The method of claim 16, further, comprising the step of unhooking said second lace section from said second hook.

18. The method of claim 14, further, comprising the steps of:

unhooking said lace from at least one of said loop-receiving means, and hooking said lace on at least one other of said loop-receiving means.

19. The method of claim 14, wherein, said lace having lace portions on opposite sides of said at least one knot respectively, the method further comprising the steps of:

Holding said lace portions, and

Pulling said lace portions and one of said lace ends in opposite directions.

* * * * *